US010453637B2

(12) United States Patent
Yang et al.

(10) Patent No.: US 10,453,637 B2
(45) Date of Patent: Oct. 22, 2019

(54) DIRECT CURRENT AIR CIRCUIT BREAKER

(71) Applicant: LSIS CO., LTD., Anyang-si, Gyeonggi-do (KR)

(72) Inventors: Seungpil Yang, Anyang-si (KR); Sangchul Lee, Anyang-si (KR); Youngkook Kim, Anyang-si (KR); Ilhyun Kim, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/007,401

(22) Filed: Jun. 13, 2018

(65) Prior Publication Data

US 2019/0035588 A1 Jan. 31, 2019

(30) Foreign Application Priority Data

Jul. 27, 2017 (KR) ..... 10-2017-0095657

(51) Int. Cl.

| | |
|---|---|
| ***H01H 21/04*** | (2006.01) |
| ***H01H 21/54*** | (2006.01) |
| ***H01H 71/56*** | (2006.01) |
| ***H01H 71/04*** | (2006.01) |
| ***H01H 71/12*** | (2006.01) |
| ***H01H 71/08*** | (2006.01) |

(Continued)

(52) U.S. Cl.

CPC ..... *H01H 71/04* (2013.01); *H01H 71/08* (2013.01); *H01H 71/12* (2013.01); *H01H 71/128* (2013.01); *H01H 71/56* (2013.01); *H01H 1/44* (2013.01); *H01H 21/04* (2013.01); *H01H 21/50* (2013.01); *H01H 21/54* (2013.01); *H01H 71/123* (2013.01); *H01H 2071/046* (2013.01)

(58) Field of Classification Search

CPC ..... H01H 71/04; H01H 71/56; H01H 71/12; H01H 71/128; H01H 2071/046; H01H 2071/0278; H01H 21/54; H01H 21/50; H01H 21/04; H01H 1/44

See application file for complete search history.

(56) References Cited

U.S. PATENT DOCUMENTS 5,477,016 A * 12/1995 Baginski ..... H01H 9/282 200/308

6,437,262 B1 8/2002 Gupta et al.

(Continued)

FOREIGN PATENT DOCUMENTS

CN 1574152 A 2/2005
CN 103703532 A 4/2014

(Continued)

OTHER PUBLICATIONS

Korean Office Action for related Korean Application No. 10-2017-0095657; (5 pages).

(Continued)

*Primary Examiner* — Vanessa Girardi
(74) *Attorney, Agent, or Firm* — K&L Gates LLP

(57) ABSTRACT

A direct-current (DC) air circuit breaker for opening and closing a circuit according to various embodiments includes a circuit unit having a main circuit, a detecting unit having a detection circuit for detecting a fault current in the main circuit, and a circuit operating device configured to allow connection or isolation between the main circuit and the detection circuit.

7 Claims, 8 Drawing Sheets

(51) Int. Cl.
*H01H 1/44* (2006.01)
*H01H 21/50* (2006.01)

(56) References Cited

U.S. PATENT DOCUMENTS

| | | | | |
|---|---|---|---|---|
| 6,960,731 | B2 * | 11/2005 | Azzola | H01H 1/226 200/244 |
| 7,439,835 | B2 | 10/2008 | Dietrich et al. | |
| 7,474,194 | B2 * | 1/2009 | Darr | H01H 9/104 337/59 |
| 8,981,244 | B2 | 3/2015 | Ho et al. | |
| 2018/0240634 | A1 * | 8/2018 | Yang | H01H 71/128 |

FOREIGN PATENT DOCUMENTS

| | | | |
|---|---|---|---|
| EP | 2028678 | A1 | 2/2009 |
| EP | 3364439 | A1 | 8/2018 |
| JP | 2004349063 | A | 12/2004 |
| JP | 2008177098 | A | 7/2008 |
| JP | 2008310988 | A | 12/2008 |
| JP | 2012125053 | A | 6/2012 |
| KR | 1020010099395 | A | 11/2001 |
| KR | 20040100863 | A | 12/2004 |
| KR | 2020120001883 | U | 3/2012 |
| KR | 20170008506 | A | 1/2017 |

OTHER PUBLICATIONS

European Search Report for related European Application No. 18175097.7; action dated Jan. 1, 2019; (8 pages).
Japanese Office Action for related Japanese Application No. 2018-117863; action dated Jun. 25, 2019; (3 pages).
Chinese Office Action for related Chinese Application No. 201810825248.X; Action dated May 31, 2019; (7 pages).

* cited by examiner

DIRECT CURRENT AIR CIRCUIT BREAKER

CROSS-REFERENCE TO RELATED APPLICATION

Pursuant to 35 U.S.C. § 119(a), this application claims the benefit of an earlier filing date of and the right of priority to Korean Application No. 10-2017-0095657, filed on Jul. 27, 2017, the contents of which are incorporated by reference herein in its entirety.

BACKGROUND OF THE INVENTION

1. Field of the Invention

Various embodiments relate to a direct-current (DC) air circuit breaker having a circuit operating device for maintenance.

2. Description of the Related Art

Generally, a circuit breaker is installed between a power source and a load to open and close a circuit. That is, the circuit breaker detects a fault current in the circuit and blocks the circuit, thereby protecting facilities and human lives. Such circuit breaker may include a main circuit and a detection circuit. The main circuit is provided for substantially opening and closing the circuit, and the detection circuit is provided for determining a status of the circuit. Here, the main circuit may break the circuit, in response to the detection circuit detecting the fault current.

However, the related art circuit breaker is implemented in a structure in which isolation between the main circuit and the detection circuit is impossible. This causes difficulty in inspection for maintenance. Therefore, a configuration is required for isolating the main circuit and the detection circuit from each other in the circuit breaker.

SUMMARY OF THE INVENTION

A circuit operating device according to various embodiments enables maintenance of a DC air circuit breaker. That is, for the maintenance of the DC air circuit breaker, the circuit operating device can isolate a main circuit and a detection circuit from each other in the DC air circuit breaker.

A DC air circuit breaker according to various embodiments may include a circuit unit having a main circuit, a detecting unit having a detection circuit for detecting a fault current in the main circuit, and a circuit operating device configured to allow connection or isolation between the main circuit and the detection circuit.

According to various embodiments, the circuit operating device may include a first fixing unit having a first fixed terminal connected to one of the main circuit and the detection circuit, a second fixing unit connected to another one of the main circuit and the detection circuit and having a second fixed terminal facing the first fixed terminal, and a moving unit provided with a rotating portion disposed in parallel between the first fixing unit and the second fixing unit, and a movable terminal disposed through the rotating portion to be brought into contact with or separated from the first fixed terminal and the second fixed terminal according to the rotation of the rotating portion.

According to various embodiments, each of the first fixed terminal and the second fixed terminal may include a fixed contact portion fixed to the first fixing unit or the second fixing unit through one end thereof and exposed to face the moving unit.

According to various embodiments, the movable terminal may include unit terminals disposed to face the first fixing unit and the second fixing unit, respectively. Each of the unit terminals may include a connecting portion fixed to the rotating portion, and a movable contact portion extending from the connecting portion, curved convexly toward the first fixing unit or the second fixing unit, and brought into contact with or separated from the fixed contact portion.

According to various embodiments, the movable contact portion may be provided with at least two legs branched from the connecting portion.

According to various embodiments, the movable terminal may further include a connecting member inserted through the rotating portion to connect the unit terminals.

According to various embodiments, one direction in which the rotating portion rotates may be defined such that the movable terminal is brought into contact with the first fixed terminal and the second fixed terminal. The movable contact portion may extend from the connecting portion in another direction opposite to the one direction. The fixed contact portion may extend from the inserting portion along the one direction.

According to various embodiments, the moving unit may further include a handle disposed on a circumferential region of the rotating portion, and balls disposed with being spaced apart from each other with a center of the rotating portion interposed therebetween on an axis extending from the center of the rotating portion to the handle, and movable between the rotating portion and at least one of the first fixing unit and the second fixing unit according to the rotation of the rotating portion.

According to various embodiments, at least one of the first fixing unit and the second fixing unit may include a first ball guide portion guiding one of the balls between the center of the rotating portion and the handle, and provided with two first concave portions formed concavely with respect to the rotating portion, and a first convex portion curved convexly between the first concave portions, and a second ball guide portion guiding another one of the balls at an opposite side of the first ball guide portion with the center of the rotating portion interposed therebetween, and provided with two second concave portions formed concavely with respect to the rotating portion, and a second convex portion curved convexly between the second concave portions. A width of the second convex portion may be greater than a width of the first convex portion.

At least one of the first fixing unit and the second fixing unit may externally expose the handle and provides a movable region of the handle, and the width of the second convex portion may be decided according to a distance of the movable region.

According to various embodiments, a circuit operating device can separate a main circuit and a detection circuit from each other in a DC air circuit breaker based on a user's operation. Thus, for maintenance of the DC air circuit breaker, the operating device can separate the main circuit and the detection circuit from each other in the DC air circuit breaker. This may result in allowing maintenance of the DC air circuit breaker.

DETAILED DESCRIPTION OF THE PREFERRED EMBODIMENT

Figure 1A:
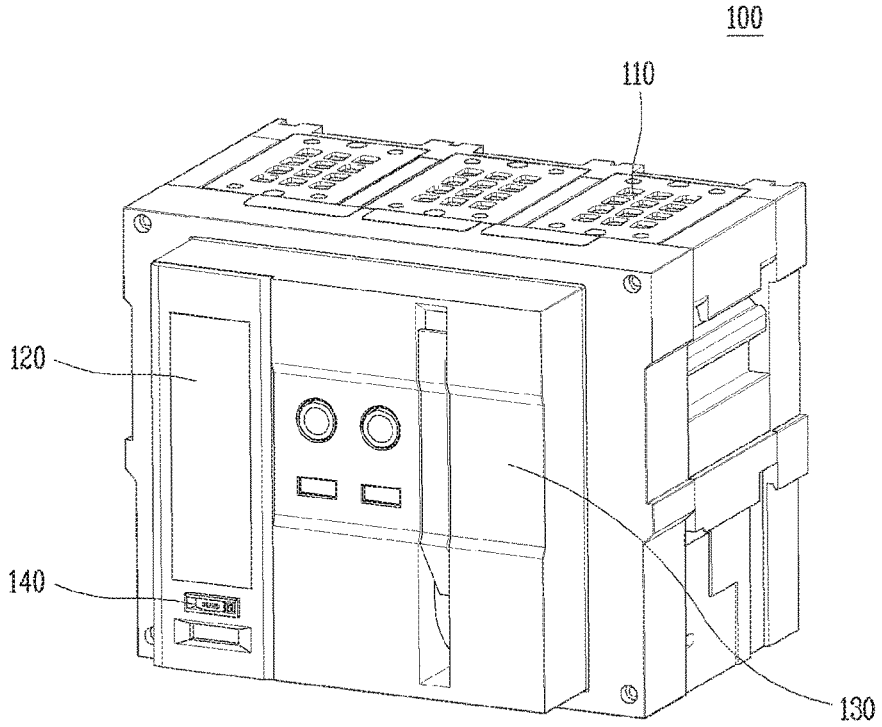
FIGS. 1A and 1B are a perspective view and a front view of a circuit breaker in accordance with one embodiment of the present invention.

Hereinafter, various embodiments of the present invention will be described with reference to the accompanying drawings. However, it should be understood that the technology described in this invention is not limited to particular embodiments, but should be understood as including various modifications, equivalents, and/or alternatives. In description of the drawings, the same/like reference numerals may be used for the same/like elements.

As used herein, the term "first," "second" or the like may be used to denote various components, regardless of order and/or importance, and may be used to distinguish one component from another without limiting the corresponding component.

Figure 1B:
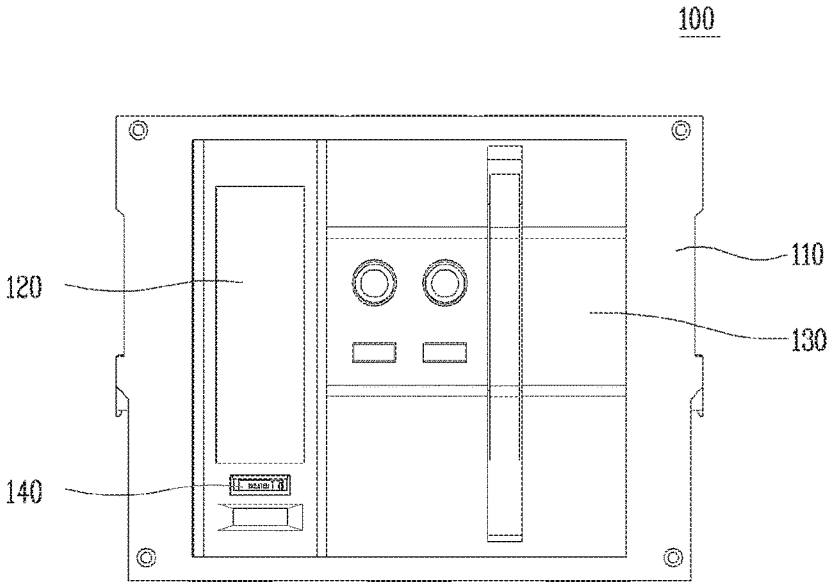
Figure 2A:
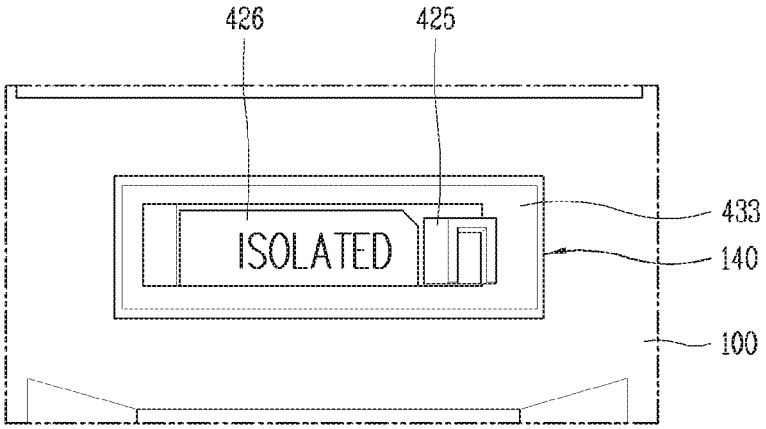
FIGS. 2A and 2B are detailed views of an operating device part of FIG. 1, which illustrates a change of a display portion according to a manipulation of a handle.
Figure 2B:
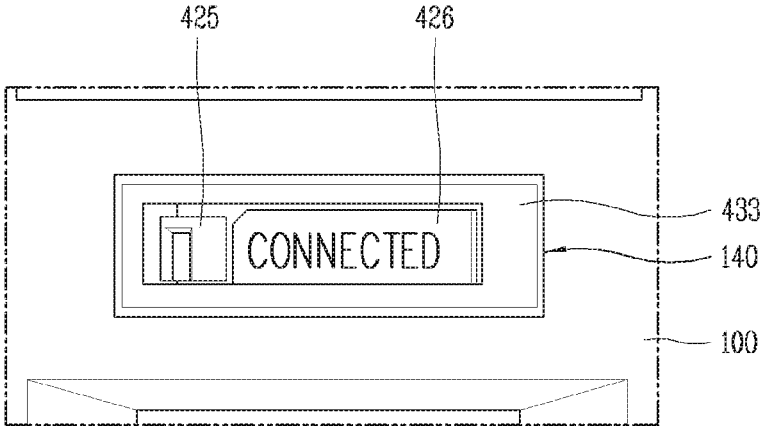

FIGS. 1A and 1B are a perspective view and a front view of a circuit breaker 100 in accordance with one embodiment of the present invention. FIGS. 2A and 2B are detailed views of an operating device part of FIG. 1, which illustrates a change of a display portion according to a manipulation of a handle.

The circuit breaker 100 according to one embodiment of the present invention may include a circuit unit 110, a detecting unit 120, an opening/closing unit 130, and an operating unit 140.

The circuit unit 110 may be provided to supply currents to a circuit between a power source and a load. The circuit between the power source and the load and/or a circuit connected to the power source or the load in the circuit unit 110 is referred to as a main circuit. The circuit unit 110 may include a fixed contactor, a movable contactor, and an arc-extinguishing portion. The fixed contactor may include fixed contacts, and the respective fixed contacts may be connected to the circuit. The movable contactor may include a movable contact. At this time, when the fixed contacts and the movable contact come into contact with each other, currents may be supplied. On the other hand, when the fixed contacts and the movable contact are separated from each other, currents may be cut off. The arc-extinguishing portion may extinguish an arc caused due to the contact and separation between the fixed contacts and the movable contact.

The detecting unit 120 may recognize (detect) a state of the circuit between the power source and the load, that is, the state of the main circuit. At this time, the detecting unit 120 may detect whether or not a fault current is generated in the main circuit. Here, the detecting unit 120 may detect, for example, an overcurrent, a short-circuit current, or the like as the fault current. For example, the detecting unit 120 may include an overcurrent relay (OCR) 120.

The opening/closing unit 130 may control the circuit unit 110. At this time, the opening/closing unit 130 may control the movable contactor according to the state of the circuit. The opening/closing unit 130 may control the movable contactor to be brought into contact with or separated from the fixed contacts. Here, the opening/closing unit 130 may separate the movable contact from the fixed contacts when the fault current is generated.

The operating unit 140 may be provided for maintenance of the circuit breaker 100. The operating unit 140 may refer to an operating device 400 to be described later or a part of the operating device 400. The operating unit 140 may be configured such that the circuit unit 110 and the detecting unit 120 or the detecting unit 120 and the opening/closing unit 130 can be connected to each other or isolated from each other by a user's operation. That is, upon the maintenance of the circuit breaker 100, the operating unit 140 may isolate the circuit unit 110 and the detecting unit 120 from each other. Therefore, the main circuit and the detection circuit are separated from each other. When the maintenance of the circuit breaker 100 is completed, the operating unit 140 may connect the circuit unit 110 and the detecting unit 120 to each other. In this case, the main circuit and the detection circuit are connected to each other.

The operating unit 140 may be operated as illustrated in FIGS. 2A and 2B. Here, as illustrated in FIG. 2A, when a handle 425 is turned to one side, the operating unit 140 may isolate the circuit unit 110 and the detecting unit 120 from each other (As described above, in the present invention, the connection or isolation between the circuit unit and the detecting unit may be used as the same meaning as a connection or isolation between the main circuit and the detection circuit). At this time, a display portion 426 displays the isolated state. On the other hand, as illustrated in FIG. 2B, when the handle 425 is turned to another side, the operating unit 140 may connect the circuit unit 110 and the detecting unit 120 to each other. At this time, the display portion 426 displays the connected state.

Figure 3:
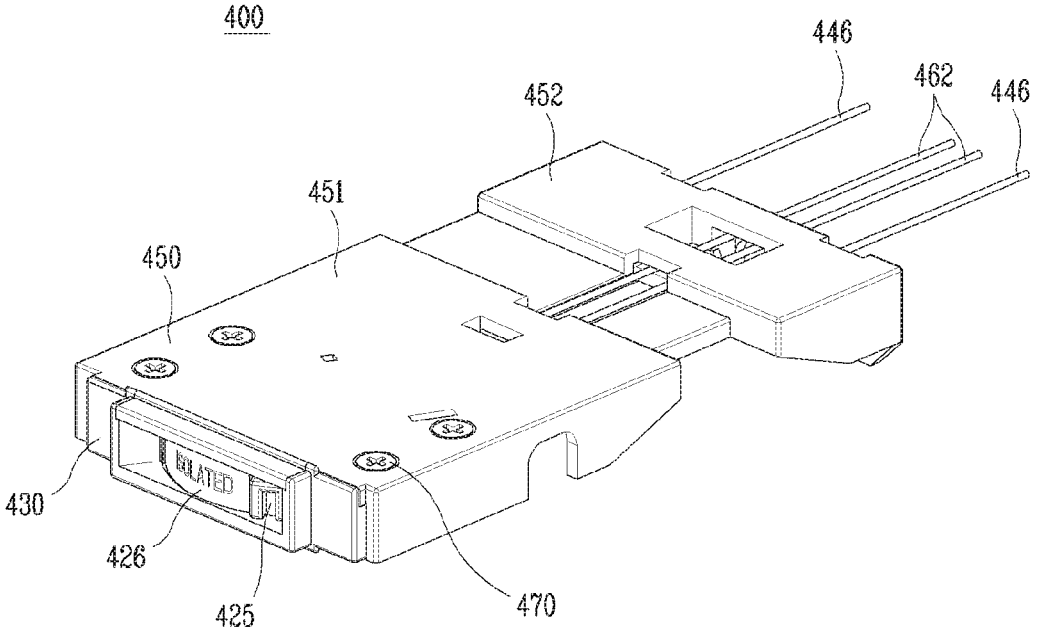
FIG. 3 is a perspective view of a circuit operating device in accordance with one embodiment of the present invention.
Figure 4:
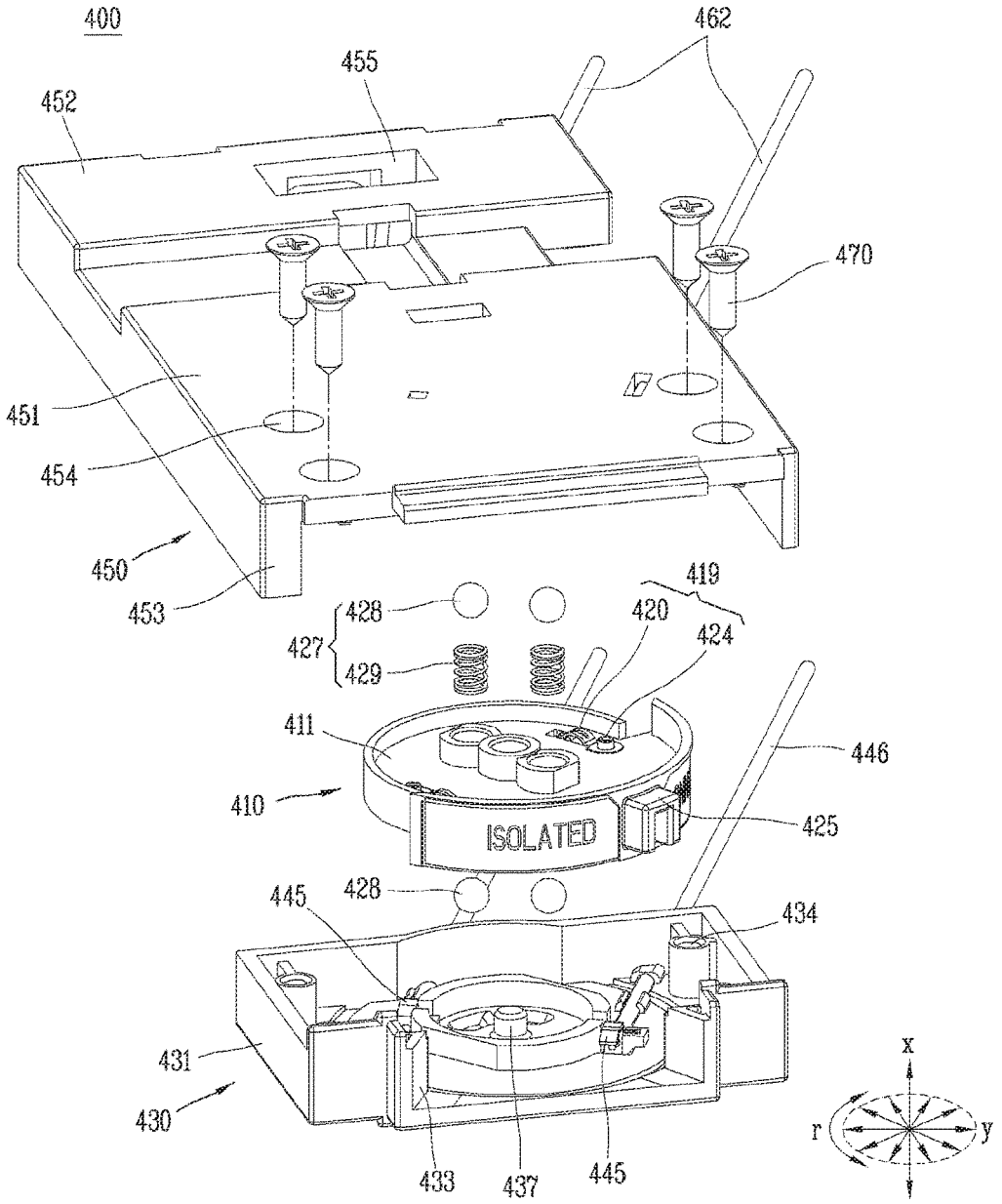
FIG. 4 is an exploded perspective view of FIG. 3.

FIG. 3 is a perspective view of a circuit operating device in accordance with one embodiment of the present invention. FIG. 4 is an exploded perspective view of FIG. 3.

Figure 5:
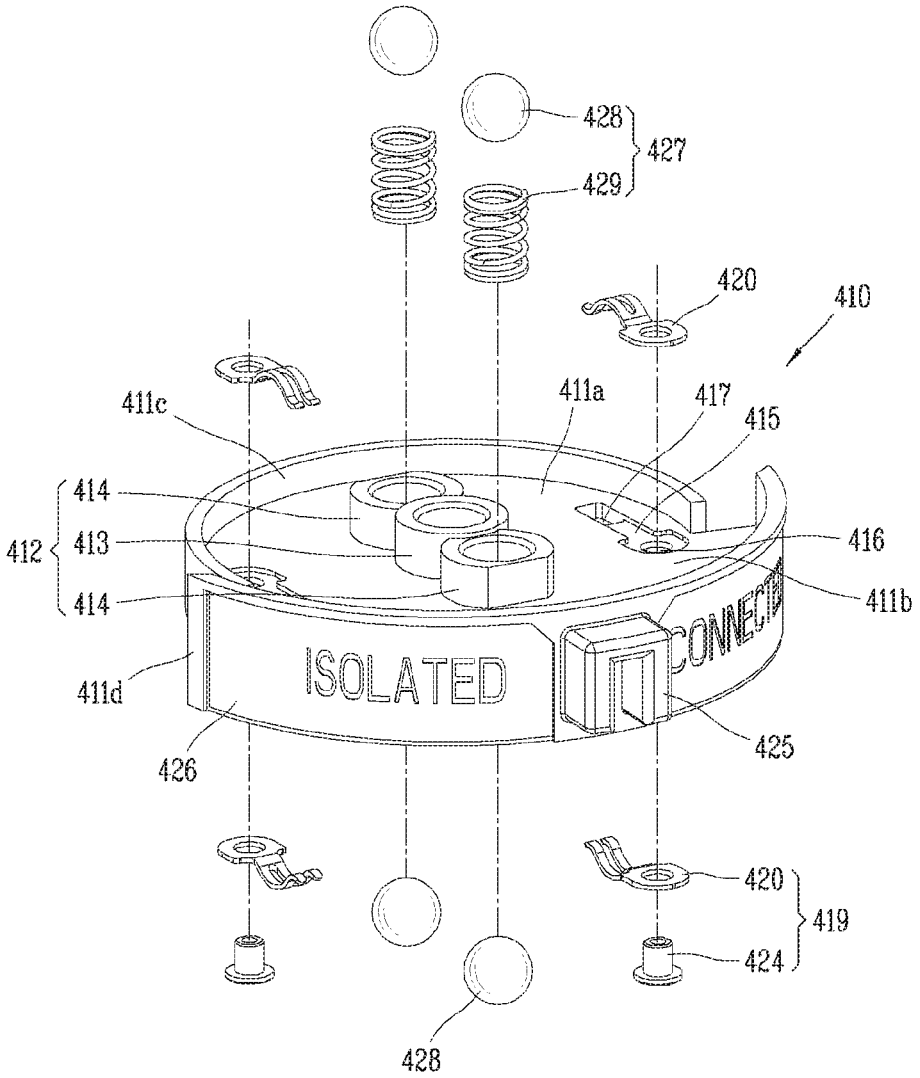
FIG. 5 is a perspective view illustrating a moving unit of FIG. 4.
Figure 6:
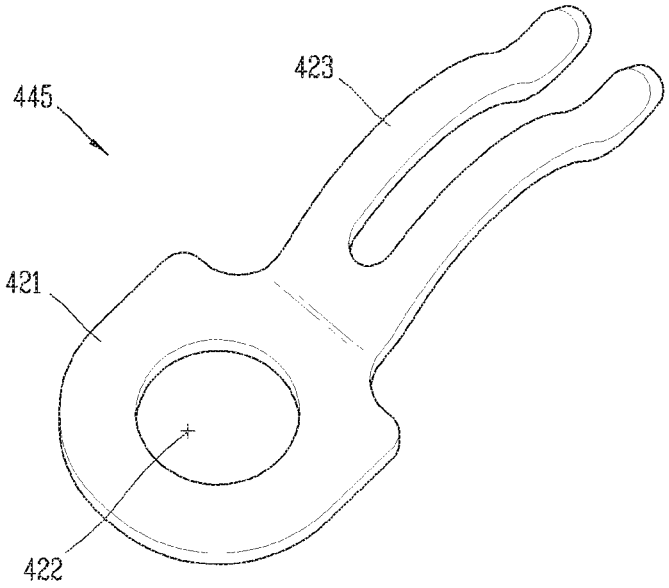
FIG. 6 is an enlarged view of a unit terminal of a movable terminal in FIG. 4.
Figure 7A:
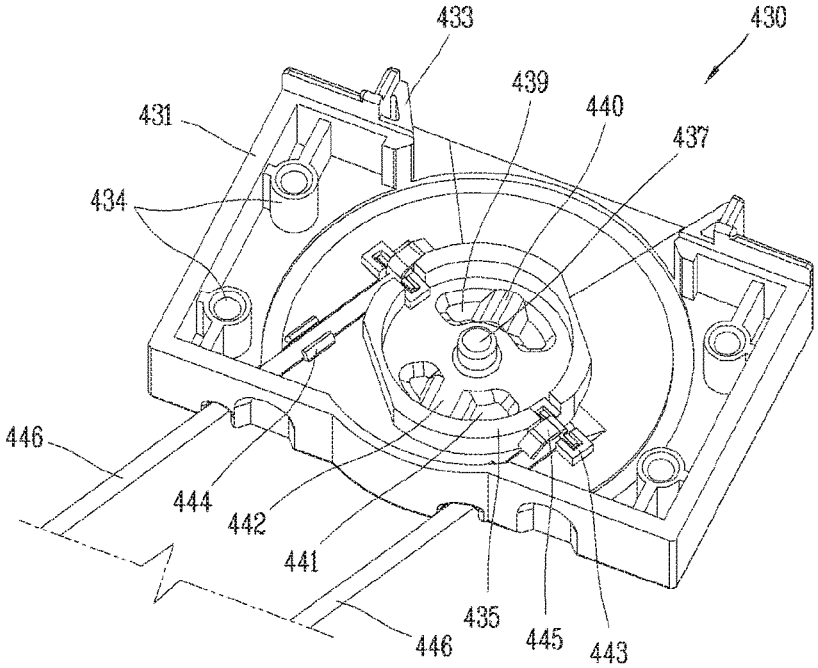
FIGS. 7A and 7B are perspective views illustrating a first fixing unit in FIG. 4.
Figure 7B:
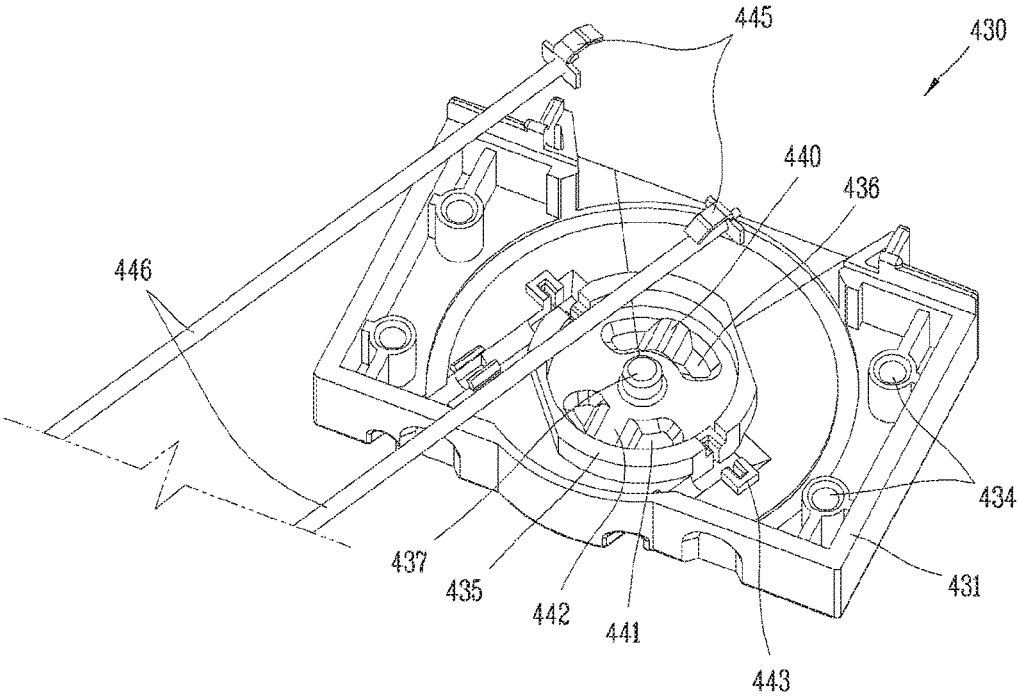
Figure 8:
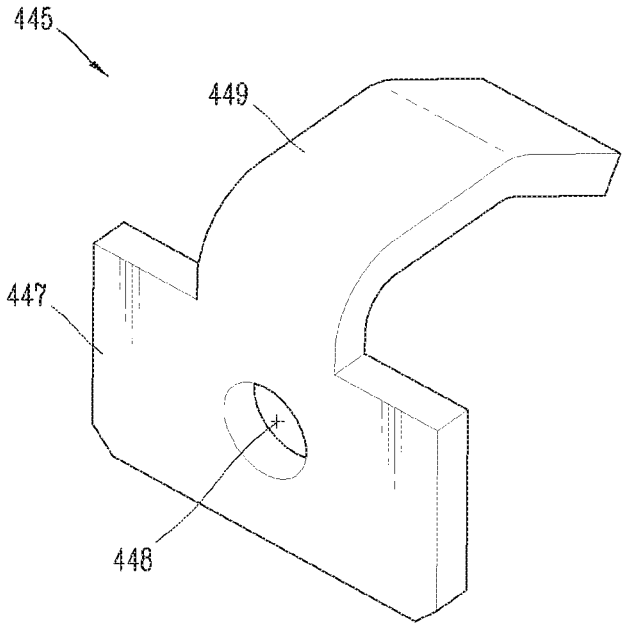
FIG. 8 is an enlarged view illustrating a first fixed terminal in FIG. 4.

FIG. 5 is a perspective view illustrating a moving unit 410 in FIG. 4, and FIG. 6 is an enlarged view illustrating a unit terminal 420 of a movable terminal 419 in FIG. 4. Also, FIGS. 7A and 7B are perspective views illustrating a first fixing unit 430 in FIG. 4, and FIG. 8 is an enlarged view of a first fixed terminal 445 in FIG. 4. The circuit operating device 400 may include a moving unit 410, a first fixing unit 430, a second fixing unit 450, and coupling members 470. At this time, an x-direction, a y-direction, and an r-direction may be defined (see FIG. 4). The x-direction (here, an x-axis is a line passing through a center of a first accommodating portion 413) may indicate a direction in which the moving unit 410, the first fixing portion 430 and the second fixing portion 450 are stacked. The y-direction (a radial direction of the x-axis) is perpendicular to the x-direction and may indicate a direction extending from inside to outside of the first fixing unit 430 and the second fixing unit 450. The r-direction (a circumferential direction rotating centering on the x-axis) may correspond to a rotating direction of the moving unit 410. Here, the r-direction may include a clockwise direction and a counterclockwise direction.

The moving unit 410 may be rotatably coupled between the first fixing unit 430 and the second fixing unit 450. At this time, the moving unit 410 may rotate along the r-direction centering on the x-direction. The moving unit 410 may include a rotating portion 411, movable terminals 419, a handle 425, and two elastic portions 427.

The rotating portion 411 may be disposed in parallel between the first fixing unit 430 and the second fixing unit 450. The rotating portion 411 may be implemented as a rotary plate that is rotatably disposed between the first fixing unit 430 and the second fixing unit 450. At this time, the rotating portion 411 may support the movable terminals 419, the handle 425, and the elastic portion 427. The rotating portion 411 may maintain insulation between the moving unit 410 and the first fixing unit 430 and the second fixing unit 450. For this, a circumferential region of the rotating portion 411 may protrude to face the first fixing unit 430 and the second fixing unit 450. In addition, the rotating portion 411 may be made of an insulating material. The rotating portion 411 may include an accommodating portion 412 and a movable terminal portion 415.

The rotating portion 411 may be formed in a circular shape, i.e., a disc-like shape. A part of the rotating portion 411 may be formed larger in diameter than the other portion. For example, one semicircular portion of the rotating portion 411 may be formed larger in diameter than the other semicircular portion. Here, a portion with a small diameter is referred to as a first rotating portion 411*a*, and a portion with a large diameter is referred to as a second rotating portion 411*b*. A first outer wall 411*c* protrudes from a circumference of the first rotating portion 411*a* and a second outer wall 411*d* protrudes from a circumference of the second rotating portion 411*b*.

The display portion 426 is formed on an outer circumferential surface of the second outer wall 411*d*. The display portion 426 is exposed to a front surface of the circuit breaker 100. The display portion 426 is provided with a sign (mark, indicator) indicating the connected state or the isolated state. In this example, a sticker may be attached.

The accommodating portion 412 may be disposed at a central region of the rotating portion 411. At this time, the accommodating portion 412 may be formed through the rotating portion 411. Here, the accommodating portion 412 may penetrate through the rotating portion 411 in the x-direction. The accommodating portion 412 may be formed to have a predetermined depth (height). The accommodating portion 412 may be formed in a shape of a circular pipe or a cylinder.

The accommodating portion 412 may include a first accommodating portion 413 and a second accommodating portion 414. The first accommodating portion 413 may be disposed at the center of the rotating portion 411 and the second accommodating portion 414 may be disposed adjacent to the first accommodating portion 413.

At this time, the second accommodating portions 414 may be arranged on an axis extending from the first accommodating portion 413 in the y-direction, and the first accommodating portion 413 may be disposed between the second accommodating portions 414. For example, the second accommodating portions 414 may be arranged on an axis extending from the first accommodating portion 413 to the handle 425. One of the second accommodating portions 414 may be disposed between the first accommodating portion 413 and the handle 425 and the other of the second accommodating portions 414 may be disposed opposite to the one second accommodating portion 414 with the first accommodating portion 413 interposed therebetween.

The movable terminal portions 415 may be disposed in an edge region of the rotating portion 411. The movable terminal portions 415 may be provided as a pair spaced apart from each other by a predetermined angle based on the first accommodating portion 412. Here, the movable terminal portions 415 may be recessed from the rotating portion 411 in the x-direction. In other words, the movable terminal portions 415 may be recessed in a manner of facing the first fixing unit 430 and the second fixing unit 450. At this time, the movable terminal portions 415 may be disposed on opposite sides to each other based on an axis at which the accommodation portions 412 are arranged.

Each of the movable terminal portions 415 may include a terminal hole 416 and an auxiliary hole 417.

The terminal hole 416 and the auxiliary hole 417 may be formed through the rotating portion 411. Here, the terminal hole 416 and the auxiliary hole 417 may penetrate through the rotating portion 411 in the x-direction. The terminal hole 416 and the auxiliary hole 417 may be disposed adjacent to each other. At this time, in each of the movable terminal portions 415, the terminal hole 416 and the auxiliary hole 417 may be sequentially arranged along the r-direction.

The movable terminals 419 may be coupled to the movable terminal portions 415. That is, the movable terminals 419 may be disposed on opposite sides to each other with interposing an axis at which the accommodation portion 412 is arranged. Each of the movable terminals 419 may include two unit terminals 420 and a connecting member 424.

The unit terminals 420 may be seated on one of the movable terminal portions 415 on opposite sides to each other with the rotation portion 411 interposed therebetween. Each unit terminal 420 may include a connecting portion 421 and a movable contact portion 423.

The connecting portion 421 may be accommodated in the corresponding movable terminal portion 415. The connecting portion 421 may include a connection hole 426. The connection hole 426 may be formed through the connecting portion 421. Here, the connection hole 426 may be formed through the connecting portion 421 in the x-direction. And the connection hole 426 may be disposed to correspond to the terminal hole 416. That is, the connection hole 426 may be disposed on an axis passing through the terminal hole 416.

The movable contact portion 423 may be exposed in a manner of facing the first fixing unit 430 or the second fixing unit 450. To this end, the movable contact portion 423 may be connected to the connecting portion 421 and extend from the connecting portion 421. At this time, the movable contact portion 423 may extend to reach the auxiliary hole 417. Here, the movable contact portion 423 may extend along the r-direction. The movable contact portion 423 may extend from the connecting portion 421 into a curved shape. The movable terminal portion 423 may be curved to be convex toward the first fixing unit 430 or the second fixing unit 450. This may result in forming a space between the movable contact portion 423 and the rotation portion 411. Further, the movable contact portion 423 may be branched from the connecting portion 421. That is, the movable contact portion 423 may include at least two legs that individually extend from the connecting portion 421 and are spaced apart from each other. Accordingly, one end of the movable contact portion 423 may be connected to the connecting portion 421, and another end of the movable contact portion 423 may be opened. At this time, the another end of the movable contact portion 423 may be inserted into the auxiliary hole 417. For this, the another end of the movable contact portion 423 may be curved to be concave in a manner of facing the first fixing unit 430 or the second fixing unit 450.

The connecting member 424 may connect the unit terminals 420. The connecting member 424 may fix the unit terminals 420 to the movable terminal portion 415. To this end, the connecting member 424 may be inserted into the unit terminals 420 and the movable terminal portion 415. Here, the connecting member 424 may be inserted into the unit terminals 420 and the movable terminal portion 415 along the x-direction. At this time, the connecting member 424 may pass through the connection hole 426 and the terminal hole 416.

The handle 425 may be provided for a user to rotate the moving unit 410. That is, the handle 425 may apply rotational force to the moving unit 410 by the user's operation. To this end, the handle 425 may be located at the circumferential region of the rotating portion 411, particularly, at the second outer wall 411*d*. The handle 425 may protrude toward the outside of the rotating portion 411. The handle 425 may be located at a central region of the display portion 426. Here, the sign indicating the connected state or the isolated state may be attached to a left or right region of the handle 425 on the display portion 426 in a distinguishable manner. A sticker is provided on the display portion 426 to identify the rotating direction of the moving unit 410 and may be attached based on the handle 425.

The elastic portion 427 may be provided for setting a stop position of the moving unit 410 and supporting the rotation of the moving unit 410. That is, the elastic portion 427 may work together with a ball guide portion 439 to be explained later to provide or restrict a movement or stop region of the moving unit 410 and apply elastic force with respect to the rotational force applied to the moving unit 410. For this, the elastic portion 427 may be disposed in one of the first and second accommodating portions 413 and 414. Here, the elastic portion 427 may be disposed in the second accommodating portion 414, for example.

The elastic portion 427 may include at least one ball 428 and a spring 429. The ball 424 may be disposed to face at least one of the first fixing unit 430 and the second fixing unit 450. At least a portion of each ball 428 may protrude from the second accommodating portion 414 to face the first fixing unit 430 or the second fixing unit 450. The spring 429 may be inserted into the second accommodating portion 414. At this time, as the moving unit 410 is coupled to the first fixing unit 430 and the second fixing unit 450, the spring 429 may be compressed. According to one embodiment, two balls 428 may be disposed to face the first fixing unit 430 and the second fixing unit 450, respectively. Here, the spring 429 may be inserted into the second accommodating portion 414 so as to be disposed between the balls 428. The spring 429 may be compressed between the balls 424 as the moving unit 410 is coupled to the first fixing unit 430 and the second fixing unit 450. According to another embodiment, one ball 424 may be disposed to face one of the first fixing unit 430 and the second fixing unit 450. Here, the spring 429 may be inserted in the second accommodating portion 414 to be disposed between the rotating portion 411 and the ball 428. At this time, one side of the second accommodating portion 414 may be closed. The spring 429 may be compressed between the rotating portion 411 and the ball 424 as the moving unit 410 is coupled to the first fixing unit 430 and the second fixing unit 450.

The first fixing unit 430 and the second fixing unit 450 may be coupled to each other. At this time, the first fixing unit 430 and the second fixing unit 450 may be disposed in parallel along the x-direction and may be coupled to each other along the edge region. For example, the first fixing unit 430 and the second fixing unit 450 may be engaged with each other on the edge region. Alternatively, one of the first fixing unit 430 and the second fixing unit 450 may be coupled to inside of the other. For this purpose, the first fixing unit 430 and the second fixing unit 450 may protrude from their edge regions to face each other. That is, an outer wall or a side wall may be formed on the edge region of each of the first fixing unit 430 and the second fixing unit 450. Accordingly, the first fixing unit 430 and the second fixing unit 450 may form an inner space. At this time, the moving unit 410 may be accommodated and supported within the inner space between the first fixing unit 430 and the second fixing unit 450.

The first fixing unit 430 may be disposed at an opposite side of the second fixing unit 450 with respect to the moving unit 410. At this time, the first fixing unit 430 may be located at one side of the moving unit 410 in the x-direction. For example, the first fixing unit 430 may be disposed below the moving unit 410, and the moving unit 410 may be disposed above the first fixing unit 430. The first fixing unit 430 may include a first case 431 and a first fixed terminal 445.

The first case 431 may support the moving unit 410 and the second fixing unit 450. The first case 431 may maintain insulation among the moving unit 410, the first fixing unit 430 and the third fixing unit 450. To this end, the first case 431 may be formed of an insulating material. The first case 431 may include a first handle guide portion 433, coupling grooves 434, a support portion 435, a pivot 437, a first ball guide portion 439, a second ball guide portion 441, fixed terminal portions 443, and wiring guide portions 444. According to one embodiment, when the balls 428 of the moving unit 410 face the first fixing unit 430, the first case 431 may include the first ball guide portion 439 and the second ball guide portion 441. According to another embodiment, when the balls 428 of the moving unit 410 do not face the first fixing unit 430, the first case 431 may not include the first ball guide portion 439 and the second ball guide portion 441.

The first handle guide portion 433 may be disposed on one side of the first case 431. The first handle guide portion 433 may be implemented as a pair of inclined walls which are symmetrical with each other at a predetermined angle with respect to the pivot 437. The first handle guide portion 433 externally exposes a part of the second outer wall 411*d* of the moving unit 410. Accordingly, the handle 425 and a part of the display portion 426 may be exposed to the outside of the first case 431. The first handle guide portion 433 may define a movable region of the handle 425. Here, the first handle guide portion 433 may provide the movable region of the handle 425 in the r-direction. Thus, the handle 425 may be movable between both of the inclined walls of the first handle guide portion 433. In this time, a rotation angle $\alpha$ of the moving unit 410 may be defined as an angle between straight lines extending from a rotational axis of the moving unit 410 to the center of the handle 425 contacting the both inclined walls of the first handle guide portion 433.

The coupling grooves 434 may be disposed on the edge region of the first case 431. At this time, the coupling grooves 434 may be formed along the x-direction. The coupling grooves 434 may be realized with a predetermined depth.

The support portion 435 may be disposed to face the rotating portion 411 of the moving unit 410. The support portion 435 may support the rotating portion 411 of the moving unit 410. At this time, the support portion 435 may support the rotating portion 411 between the accommodating portion 412 and the movable terminal portion 415. Here, the support portion 435 may protrude in the x-direction. For example, the support portion 435 may be formed in a circular shape. Here, a diameter of the support portion 435 may be shorter than a diameter of the rotating portion 411 of the moving unit 410. Accordingly, the accommodating portion 412 of the moving unit 410 may be disposed inside the support portion 435 and the movable terminal portion 415 of the moving unit 410 may be disposed outside the support portion 435.

The pivot 437 may be located at a central region of the support portion 435. At this time, the pivot 437 may protrude to face one of the first and second accommodating portions 413 and 414 (i.e., 412) of the moving unit 410. Here, the pivot 437 may protrude in the x-direction. The pivot 437 may have a predetermined height. Accordingly, the pivot 437 may be inserted into any one of the first and second accommodating portions 413 and 414 of the moving unit 410. Here, the pivot 437 may be inserted into the first accommodating portion 413 of the moving unit 410. The pivot 437 may thus be a rotational axis of the moving unit 410, so that the moving unit 410 can rotate centering on the pivot 437 in correspondence with the first fixed portion 430.

The first ball guide portion 439 and the second ball guide portion 441 may be disposed on a central region of the support portion 435. At this time, the first ball guide portion 439 and the second ball guide portion 441 may be disposed in a manner of facing the second accommodating portions 414 of the moving unit 410. The first ball guide portion 439 may be disposed between the first handle guide portion 433 and the pivot 437 and the second ball guide portion 441 may disposed on an opposite side of the first ball guide portion 433 with the pivot 437 interposed therebetween. Accordingly, the first ball guide portion 439 and the second ball guide portion 441 can provide or limit a movable region of the balls 428. At this time, the first ball guide portion 439 and the second ball guide portion 441 may provide the movable region of the balls 428 based on a rotation angle of the moving unit 410. The first ball guide portion 439 may be formed in a curved shape so as to control pressure applied to the spring 429 by the elastic portion 427. The first ball guide portion 439 and the second ball guide portion 441 may be concave in the x-direction at the first case 431. The first ball guide portion 439 may include a first convex portion 440 and the second ball guide portion 441 may include a second convex portion 442. The first convex portion 440 may be convexly curved toward the moving unit 410 in the first ball guide portion 439 so as to divide the first ball guide portion 439 into two first concave portions. The second convex portion 442 may be curved convexly toward the moving unit 410 in the second ball guide portion 441 so as to divide the second ball guide portion 441 into two second concave portions. At this time, a width of the first convex portion 440 and a width of the second convex portion 442 may be decided on a plane arranged in the y-direction, and the width of the second convex portion 442 may be greater than the width of the first convex portion 440. Here, the width of the second convex portion 442 may be decided according to a distance between both ends of the first handle guide portion 433. Accordingly, the first ball guide portion 439 and the second ball guide portion 441 may guide the movement of the balls 428 within the rotation angle of the moving unit 410. That is, one of the balls 428 may be movable between the first concave portions over the first convex portion 440 and the other one of the balls 428 may be movable between the second concave portions over the second convex portion 442.

The fixed terminal portion 443 may be disposed on an outer region (outer surface) of the support portion 435. The fixed terminal portion 443 may be formed as a pair spaced apart from each other by a predetermined angle based on the pivot 437. At this time, the fixed terminal portion 443 may be disposed to face the movable terminal portion 415 of the moving unit 410. Each of the fixed terminal portions 443 may be formed concavely. Here, each of the fixed terminal portions 443 may be recessed in the x-direction. Further, each of the fixed terminal portions 443 may have a predetermined depth.

The wiring guide portion 444 may be disposed on an outer region of the support portion 435. At this time, the wiring guide portion 444 may be arranged on an extension path of the wiring, in a manner of being adjacent to the fixed terminal portion 443. The wiring guide portion 444 may fix the wiring. For example, the wiring guide portion 444 may be formed in an arcuate shape such that the wiring can be inserted therethrough.

A first wiring 446 is provided in the fixed terminal portion 443 and the wiring guide portion 444. The first wiring 446 is a line connected to one of the main circuit and the detection circuit.

The first fixed terminals 445 may be disposed to face the movable terminals 419. At this time, the first fixed terminals 445 may be coupled to the fixed terminal portions 443. The first fixed terminals 445 may be connected to any one of the circuit unit 110 or the detecting unit 120. Each of the first fixed terminals 445 may include an inserting portion 447 and a fixed contact portion 449.

The inserting portion 447 may be inserted into any one of the fixed terminal portions 443. At this time, at least part of the inserting portion 447 may be inserted into the fixed terminal portion 443. The inserting portion 447 may be connected to any one of the wirings. The inserting portion 447 may include an insertion hole 448. The insertion hole 448 may be formed through the inserting portion 447. Here, the insertion hole 448 may be formed through the inserting portion 447 along the r-direction. Accordingly, any one of the wirings can be inserted through at least one of the wiring guide portions 444 so as to be connected to the insertion hole 448.

The fixed contact portion 449 may be exposed toward the moving unit 410. To this end, the fixed contact portion 449 may be connected to the inserting portion 447 and extend from the inserting portion 447.

At this time, the fixed contact portion 449 may extend in a direction opposite to an extending direction of the movable contact portion 423. Here, the fixed terminal portion 449 may extend along the r-direction. The fixed contact portion 449 may extend in a manner of being curved or bent from the inserting portion 447. Here, the fixed contact portion 449 may be curved convexly toward the moving unit 410.

The second fixing unit 450 may be disposed at an opposite side to the first fixing unit 430 with respect to the moving unit 410. At this time, the second fixing unit 450 may be disposed at another side of the moving unit 410 in the x-direction. For example, the second fixing unit 450 may be disposed above the moving unit 410, and the moving unit 410 may be disposed below the second fixing unit 450. The second fixing unit 450 may include a second case 451 and second fixing terminals 465.

At this time, a part of the second fixing unit 450 may be implemented in a symmetrical structure with the first fixing unit 430 with respect to the moving unit 410. In this case, since the second fixing unit 450 is similar to the first fixing unit 430, detailed description thereof will be omitted. The second handle guide portion 453 of the second case 451 may be coupled to the first handle guide portion 433 of the first case 431 so as to define the movable region of the handle 425 together with the first handle guide portion 433. Coupling holes 454 of the second case 451 may be disposed on the same line extending from (to be aligned with) the coupling grooves 434 of the first case 431 and may be formed along the x-direction.

And second wirings 462 are disposed in the second fixing unit 450. The second wirings 450 are connected to the second fixed terminals 465. The second wirings 462 are connected to a circuit, to which the first wirings 442 are not connected, of the main circuit or the detection circuit.

An extending portion 452 is formed at the rear of the second case 451. The extending portion 452 is provided with a guide and wiring hole 455 through which each of the wirings 442 and 462 can be guided.

The coupling members 470 may couple the first fixing unit 430 and the second fixing unit 450 to each other. Here, the coupling members 470 may couple the first fixing unit 430 and the second fixing unit 450 to each other in the x-direction. At this time, each of the coupling members 470 may be inserted into the coupling groove 434 of the first case 431 and the coupling hole 454 of the second case 451. Here, the coupling member 470 may be inserted through the coupling hole 454 of the second case 451 to be coupled to the coupling groove 434 of the first case 431.

According to various embodiments, the handle 425 may move within the first handle guide portion 433 and the second handle guide portion 453, based on the user's operation. Accordingly, a rotational force may be applied to the moving unit 410 between the first fixing unit 430 and the second fixing unit 450 according to the user's operation. Correspondingly, the balls 428 of the elastic portions 427 may move in the first ball guide portion 439 and the second ball guide portion 441. Here, as the balls 428 roll over the first convex portion 440 and the second convex portion 442, an elastic force can be applied to the balls 428 from the springs 429. That is, as the springs 429 are compressed by the balls 428, a pushing force may be applied to the balls 428 from the springs 429. Accordingly, the moving unit 410 can rotate between the first fixing unit 430 and the second fixing unit 450 based on the rotational force and the elastic force.

At this time, a width of the second convex portion 442 may be wider than a width of the first convex portion 440.

Accordingly, one of the balls 428 may roll over the first convex portion 440 and then the other one of the balls 428 may roll over the second convex portion 442. As one of the balls 428 rolls over the first convex portion 440, the handle 425 can move primarily between both ends of the first handle guide portion 433. As the other of the balls 428 rolls over the second convex portion 442, the handle 425 may be brought into close contact with one of the both ends of the first handle guide portion 433.

According to various embodiments, as the moving unit 410 rotates between the first fixing unit 430 and the second fixing unit 430, the movable terminals 419 may move between the first fixed terminals 445 and the second fixed terminals 465. Here, in the r-direction, one direction and another direction opposite to the one direction may be defined. The movable contact portion 423 may extend from the connecting portion 421 along the another direction and the fixed contact portion 449 may extend from the inserting portion 447 along the one direction. As a result, a current supply between the wirings may be controlled between the movable terminal portions 419 and the first fixed terminals 445 and the second fixed terminals 465.

At this time, as the moving unit 410 rotates in the one direction, the movable terminals 419 may be brought into contact with the first fixed terminals 445 and the second fixed terminals 465. The movable contact portion 423 can be brought into contact with the fixed contact portion 429 as the connecting portion 421 passes through the inserting portion 447 in an intersecting manner. Here, the movable contact portion 423 may be branched into at least two legs such that a plurality of contacts can be formed between the movable contact portion 423 and the fixed contact portion 449.

As the movable contact portion 423 slides in contact with the fixed contact portion 429, the movable contact portion 423 may be compressed with respect to the movable terminal portion 415. Thus, the contact state between the movable contact portion 423 and the fixed contact portion 449 can be maintained. For example, when the handle 425 is brought in close contact with one end of the first handle guide portion 433, the movable contact portion 423 may be in contact with the fixed contact portion 449. As a result, the current supply between the wirings may be allowed between the movable terminals 419 and the first fixed terminal 445 and the second fixed terminal 465.

Thus, the circuit unit 110 and the detecting unit 120 can be connected to each other.

As the moving unit 410 rotates in the another direction, the movable terminals 419 can be separated from the first fixed terminals 445 and the second fixed terminals 465. Here, the compressed movable contact portion 423 may be restored. For example, when the handle 425 is brought into close contact with the another end of the first handle guide portion 433, the movable contact portion 423 may be separated from the fixed contact portion 449. As a result, the current supply between the wirings may be cut off between the movable terminals 419 and the first fixed terminals 445 and the second fixed terminals 465. Accordingly, the circuit unit 110 and the detecting unit 120 can be separated from each other.

Consequently, the main circuit and the detection circuit can be connected to or separated from each other.

This may facilitate maintenance of the circuit breaker. Also, since the handle and the display portion of the circuit operating device are exposed to the front surface of the circuit breaker, such handle and display portion can be easily controlled and the connected or separated state between the main circuit and the detection circuit can be visually checked.

The terminology used herein is for the purpose of describing specific embodiments only and is not intended to limit the scope of the other embodiments. A singular representation may include a plural representation unless it represents a definitely different meaning from the context. Terms used herein, including technical or scientific terms, may have the same meaning as commonly understood by one of ordinary skill in the art to which the present invention belongs. Terms defined in the general dictionary of terms used herein may be construed as the same or similar meaning as that in the context of the related technology, and should not be construed too ideally or excessively, unless otherwise clearly defined in this document. In some cases, even the terms defined in this document cannot be construed to exclude the embodiments of this document.

What is claimed is:

1. A direct-current (DC) air circuit breaker, comprising:

a circuit unit having a main circuit;

a detecting unit having a detection circuit for detecting a fault current in the main circuit; and a circuit operating device configured to allow connection or isolation between the main circuit and the detection circuit, wherein the circuit operating device comprises:

a first fixing unit having a first fixed terminal connected to one of the main circuit and the detection circuit;

a second fixing unit connected to another one of the main circuit and the detection circuit and having a second fixed terminal facing the first fixed terminal; and a moving unit provided with a rotating portion disposed in parallel between the first fixing unit and the second fixing unit, and a movable terminal disposed through the rotating portion to be brought into contact with or separated from the first fixed terminal and the second fixed terminal according to a rotation of the rotating portion, wherein each of the first fixed terminal and the second fixed terminal comprises a fixed contact portion fixed to the first fixing unit or the second fixing unit through one end thereof and exposed to face the moving unit, wherein the movable terminal comprises unit terminals disposed to face the first fixing unit and the second fixing unit, respectively, and wherein each of the unit terminals comprises:

a connecting portion fixed to the rotating portion; and a movable contact portion extending from the connecting portion, curved convexly toward the first fixing unit or the second fixing unit, and brought into contact with or separated from the fixed contact portion.

2. The breaker of claim 1, wherein the movable contact portion is provided with at least two legs branched from the connecting portion.

3. The breaker of claim 1, wherein the movable terminal further comprises a connecting member inserted through the rotating portion to connect the unit terminals.

4. The breaker of claim 1, wherein one direction in which the rotating portion rotates is defined such that the movable terminal is brought into contact with the first fixed terminal and the second fixed terminal, wherein the movable contact portion extends from the connecting portion in another direction opposite to the one direction, and wherein the fixed contact portion extends from an inserting portion along the one direction.

5. The breaker of claim 1, wherein the moving unit further comprises:

a handle disposed on a circumferential region of the rotating portion; and balls disposed, within the rotating portion, being spaced apart from each other with a center of the rotating portion interposed therebetween on an axis extending from the center of the rotating portion to the handle, and movable between the rotating portion and at least one of the first fixing unit and the second fixing unit according to the rotation of the rotating portion.

6. The breaker of claim 5, wherein at least one of the first fixing unit and the second fixing unit comprises:

a first ball guide portion guiding one of the balls between the center of the rotating portion and the handle, and provided with two first concave portions formed concavely with respect to the rotating portion, and a first convex portion curved convexly between the first concave portions; and a second ball guide portion guiding another one of the balls at an opposite side of the first ball guide portion with the center of the rotating portion interposed therebetween, and provided with two second concave portions formed concavely with respect to the rotating portion, and a second convex portion curved convexly between the second concave portions, wherein a width of the second convex portion is greater than a width of the first convex portion.

7. The breaker of claim 6, wherein at least one of the first fixing unit and the second fixing unit externally exposes the handle and provides a movable region of the handle, and wherein the width of the second convex portion is decided according to a distance of the movable region.

* * * * *